US008573720B2

(12) United States Patent
Wittgrebe

(10) Patent No.: US 8,573,720 B2
(45) Date of Patent: Nov. 5, 2013

(54) GUIDE RAIL COMPRISING A RAPID FIXING DEVICE

(75) Inventor: Achim Wittgrebe, Bielefeld (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 699 days.

(21) Appl. No.: 12/223,816

(22) PCT Filed: Jan. 23, 2007

(86) PCT No.: PCT/EP2007/050659

§ 371 (c)(1),
(2), (4) Date: Oct. 6, 2008

(87) PCT Pub. No.: WO2007/090738

PCT Pub. Date: Aug. 16, 2007

(65) Prior Publication Data

US 2009/0127217 A1 May 21, 2009

(30) Foreign Application Priority Data

Feb. 10, 2006 (DE) ..... 20 2006 002 251 U

(51) Int. Cl.
*A47B 81/00* (2006.01)

(52) U.S. Cl.
USPC ..... 312/410; 126/339; 312/228.1

(58) Field of Classification Search
USPC ..... 312/408, 410, 228.1, 311, 334.1, 334.6, 312/334.27, 334.32; 126/337, 339, 332, 126/337 R, 340, 333; 211/126.15, 86.01, 211/26; 248/220.21, 221.11, 298.1; 99/450; 403/397, 398
See application file for complete search history.

(56) References Cited

U.S. PATENT DOCUMENTS 1,946,532 A * 2/1934 Hatch ..... 108/143
1,953,688 A * 4/1934 Otte ..... 108/137

(Continued)

FOREIGN PATENT DOCUMENTS

DE 35 17 001 A1 11/1986
DE 20 2004 005475 U1 7/2004
DE 20 2004 010 137 U1 9/2004
EP 0 091 666 A2 10/1983

OTHER PUBLICATIONS

German Search Report for German Patent Application No. DE 20 2006 002 251.1, dated Mar. 13, 2006.

(Continued)

*Primary Examiner* — James O Hansen
*Assistant Examiner* — Hiwot Tefera
(74) *Attorney, Agent, or Firm* — Barnes & Thornburg LLP

(57) ABSTRACT

The invention relates to a guide rail, which can be fixed to horizontal bars including angled end regions on a grid-type side part of an oven, a dishwasher or similar appliances and which has a rapid fixing device, including two retaining elements that are fixed in the end region of the guide rail and that can be detachably fixed to a bar on the grid-type side part. According to the invention, both the front and the rear retaining element have respective first and second clip-type retaining sections, the first partially encompassing the longitudinal extension of a bar and the second partially encompassing the angled end regions of said bar. The retaining section of the rear retaining element is open towards the rear of the guide rail, allowing the rail with its rapid fixing device to be pushed and fixed onto one of the bars from the front of the grid-type side part.

12 Claims, 9 Drawing Sheets

(56) References Cited

U.S. PATENT DOCUMENTS

| | | | | |
|---|---|---|---|---|
| 2,011,189 | A * | 8/1935 | Anderson | 126/339 |
| 2,078,681 | A * | 4/1937 | Otte | 312/246 |
| 2,751,653 | A * | 6/1956 | Leibow | 24/331 |
| 2,986,440 | A * | 5/1961 | Swaneck, Jr. | 312/308 |
| 3,345,706 | A * | 10/1967 | Stokes | 403/397 |
| 3,405,429 | A * | 10/1968 | Vazquez | 24/531 |
| 3,806,994 | A * | 4/1974 | Lankford | 403/397 |
| 4,666,201 | A * | 5/1987 | Chap | 294/161 |
| 4,834,555 | A | 5/1989 | Grass | |
| 4,917,340 | A * | 4/1990 | Juemann et al. | 248/74.2 |
| 5,426,832 | A * | 6/1995 | Doussot et al. | 24/543 |
| 5,639,049 | A * | 6/1997 | Jennings et al. | 248/74.2 |
| 5,697,591 | A * | 12/1997 | Cooper | 248/229.16 |
| 6,105,218 | A * | 8/2000 | Reekie | 24/518 |
| 6,148,813 | A * | 11/2000 | Barnes et al. | 126/339 |
| 6,206,206 | B1 * | 3/2001 | Saylor et al. | 211/46 |
| 6,371,419 | B1 * | 4/2002 | Ohnuki | 248/74.2 |
| 6,481,813 | B1 * | 11/2002 | Muterthies et al. | 312/348.1 |
| 6,578,720 | B1 * | 6/2003 | Wang | 211/126.15 |
| 6,643,900 | B2 * | 11/2003 | Jahrling | 24/563 |
| 6,732,662 | B2 * | 5/2004 | Welch et al. | 108/109 |
| 6,938,617 | B2 * | 9/2005 | Le et al. | 126/339 |
| 7,063,219 | B2 * | 6/2006 | Fann et al. | 211/74 |
| 7,178,678 | B2 * | 2/2007 | Mansfield et al. | 211/7 |
| 7,216,646 | B2 * | 5/2007 | Le et al. | 126/339 |
| 7,473,846 | B2 * | 1/2009 | Doerr et al. | 174/69 |
| 2004/0056157 | A1 * | 3/2004 | Dufourg | 248/68.1 |
| 2004/0069299 | A1 * | 4/2004 | Le et al. | 126/337 R |
| 2004/0112371 | A1 * | 6/2004 | Le et al. | 126/334 |
| 2005/0217501 | A1 * | 10/2005 | Babucke et al. | 99/450 |
| 2006/0065265 | A1 * | 3/2006 | Erdmann et al. | 126/339 |
| 2008/0237166 | A1 * | 10/2008 | Williams et al. | 211/169.1 |
| 2009/0016812 | A1 * | 1/2009 | Wittgrebe | 403/189 |
| 2009/0095279 | A1 * | 4/2009 | Ambrose et al. | 126/337 R |
| 2010/0218755 | A1 * | 9/2010 | Stewart et al. | 126/339 |
| 2011/0123260 | A1 * | 5/2011 | Budde | 403/188 |
| 2011/0132348 | A1 * | 6/2011 | Smith et al. | 126/339 |

OTHER PUBLICATIONS

International Search Report for International Patent Application No. PCT/EP2007/050659, dated Jul. 5, 2007.

International Preliminary Report on Patentability and Written Opinion of the International Search Authority for International Patent Application No. PCT/EP2007/050659, dated Sep. 9, 2008.

* cited by examiner

GUIDE RAIL COMPRISING A RAPID FIXING DEVICE

FIELD OF THE INVENTION

The present invention relates to a guide rail which can be fixed to horizontally running rods, which are bent away at an angle in the end region, of a grid-type side part of a baking oven, a dishwasher or similar appliances and which has a quick-action fixing device consisting of two retaining elements which are fixed in the end regions of the guide rail and can be detachably fastened to a rod of a grid-type side part.

BACKGROUND

Guide rails with quick-action fixing devices of the type in question are known per se, for example, from DE 200 10 073 U1.

Guide rails of this type with corresponding quick-action fixing devices are used in domestic appliances, such as dishwashers, baking ovens or the like, but it is likewise conceivable for them to be used in other items of furniture.

In the case of the grid-like side parts, which are formed from wire or rods, a plurality of horizontal rods running parallel to one another are provided, the rods are angled in their end regions in such a manner that the angled sections protrude in the direction of a side wall of a domestic appliance or of an item of furniture from a guide rail which is to be fixed.

SUMMARY

Illustrated embodiments provide a guide rail of the type in question which can be fixed in a secure position to a horizontally running rod of a grid-type side part and at the same time can be easily and conveniently moved into such a fixing position.

According to illustrated embodiments, this is achieved in that both the front and the rear retaining element respectively have a first clip-type retaining section, which partially engages around a rod in its longitudinal extent region, and a second clip-type retaining section, which partially engages around the rod in its angled end regions, wherein the retaining section of the rear retaining element is open in the direction of the rear side of the guide rail in order to partially engage around the rear, angled end region of the rod, such that the rail together with the quick-action fixing device can be pushed and fixed onto one of the rods, proceeding from the front side of the side grid.

Illustrated embodiments provide retaining elements that are designed in such a way that the rail can be fastened to a single rod of a side grid in a manner that practically secures it against tilting, since partial engagement around the rod takes place both in the longitudinal extent region and in the angled region. Additionally, an appropriately equipped guide rail can easily be attached to a rod of a side grid, since all that is necessary is to initially bring the rear retaining element into a position in which partial engagement around the longitudinal extent region of the rod has already taken place, and subsequently slide the guide rail to the rear to such an extent that the retaining section, which is open toward the rear side of the guide rail, strikes against the angled, rear end of the rod. In such an implementation, the guide rail can readily be angled with respect to the rod to the extent that the front retaining element is not yet engaged. If the guide rail has been displaced along the rod as far as the limit stop, the guide rail is then pivoted up in the direction of the rod until the front retaining element is moved into its intended position.

This possibility of attaching a corresponding guide rail to a rod of a side grid has utility and does not require excessive precision, since all that is necessary to ensure that the rear retaining element is initially positioned laterally on a corresponding rod. The subsequent displacing of the guide rail as far as the limit stop and the pressing against the guide rail that then needs to take place require neither a large amount of skill nor detailed technical knowledge about the construction of the guide rail and its quick-action fixing device and more or less take place intuitively.

BRIEF DESCRIPTION OF FIGURES

Exemplary embodiments are illustrated in the attached drawings and are described in more detail below. In the drawings.

DETAILED DESCRIPTION

Figure 1:
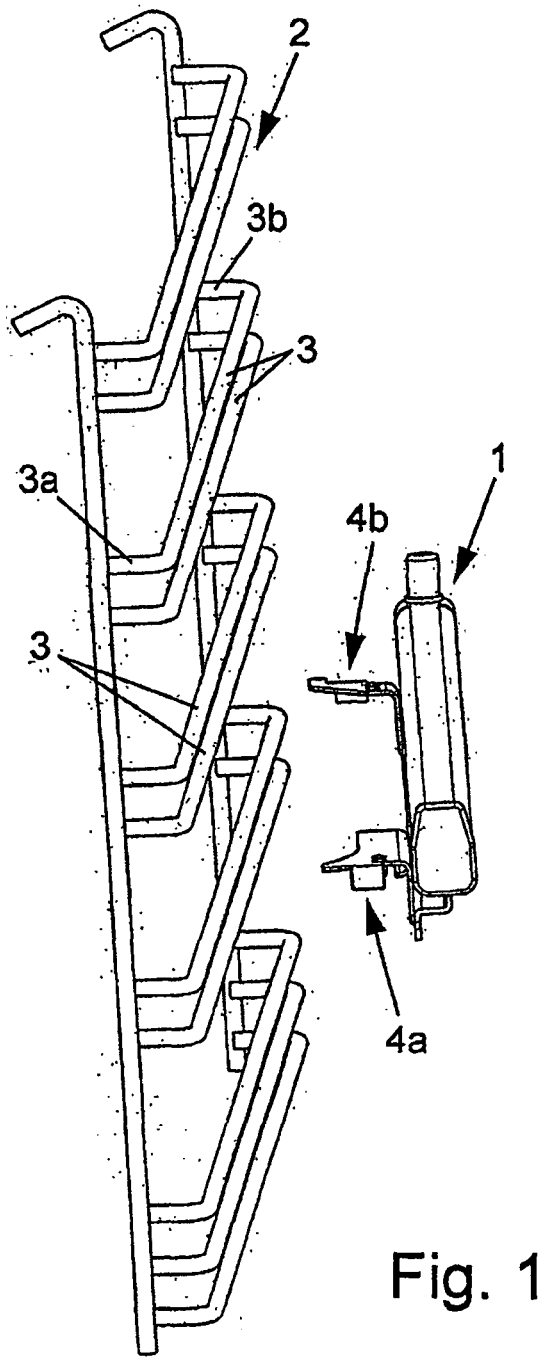
FIG. 1 shows a grid-type side part and a guide rail according to the invention that can be fixed thereto.
Figure 2:
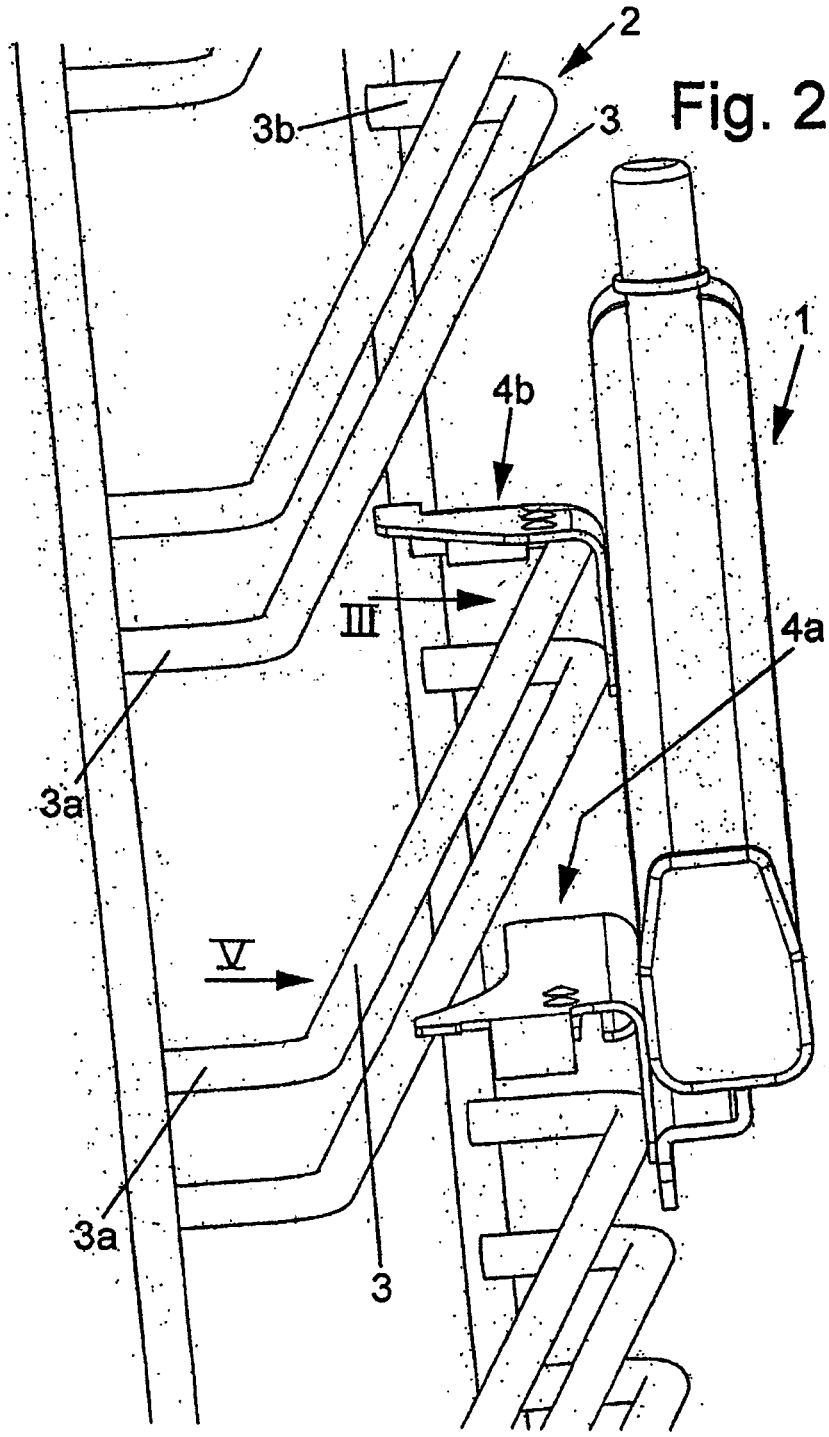
FIG. 2 shows a perspective illustration of the side grid and of the guide rail which is positioned together with a rear retaining element on a rod of the side grid.
Figure 3:
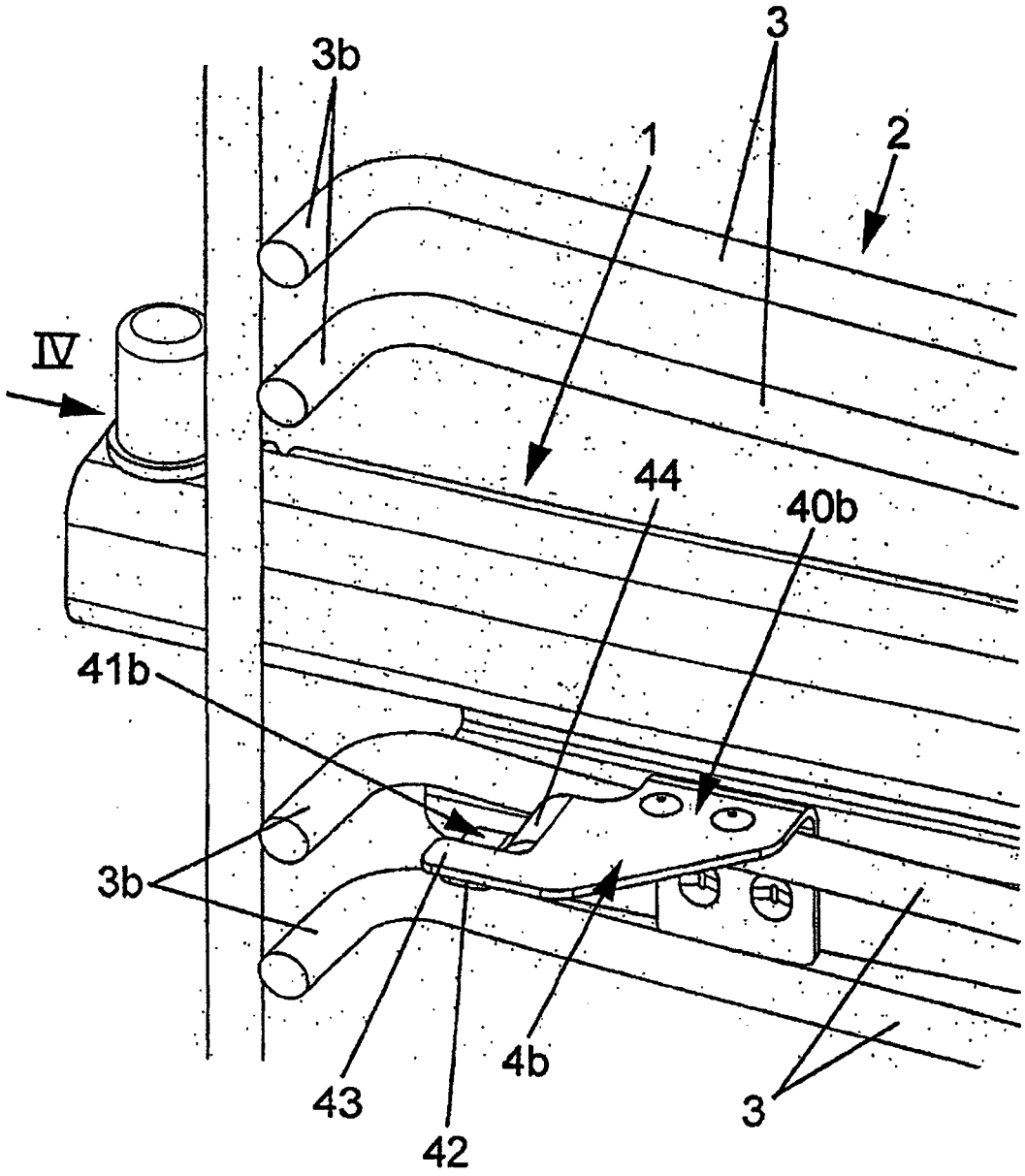
FIG. 3 shows a partial view in the direction of the arrow III in FIG. 2.
Figure 4:
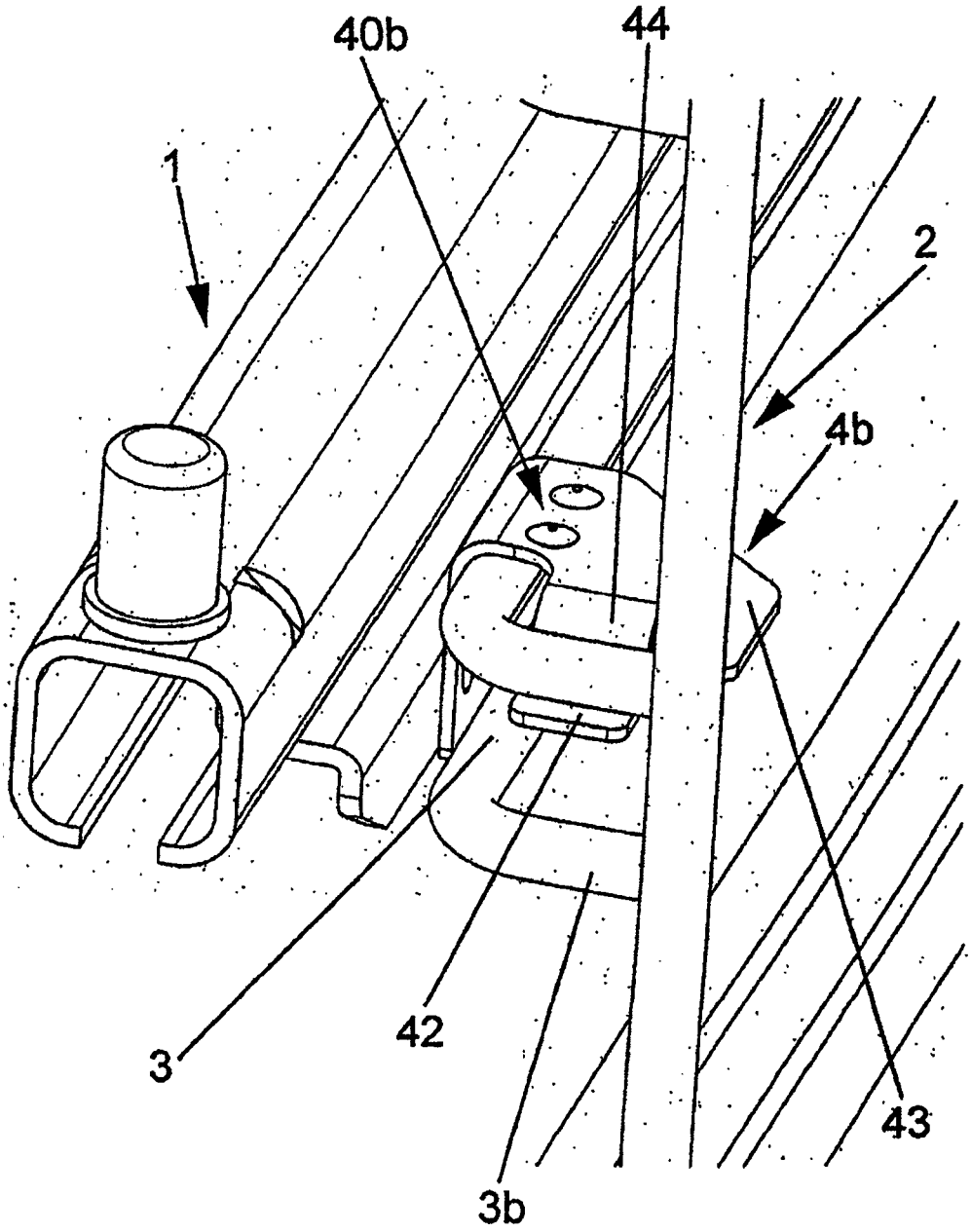
FIG. 4 shows a view in the direction of the arrow IV in FIG. 3, with the guide rail displaced completely to the rear.

In the drawings, the reference numeral 1 denotes overall a guide rail, and the reference numeral 2 denotes overall a grid-type side part, wherein the side part 2 has a plurality of horizontally running rods 3, each provided with angled end regions 3*a* and 3*b*.

The guide rail 1 is provided with a quick-action fixing device including two retaining elements 4*a* and 4*b*, which are fixed in the end regions of the guide rail 1. These retaining elements 4*a* and 4*b* serve to detachably connect the guide rail 1 to one of the rods 3 of the side part 2.

Both the front retaining element 4*a* and the rear retaining element 4*b* respectively have a first retaining section 40*a* or 40*b*, which partially engages around a rod 3 in its longitudinal extent region, and also a second retaining section 41*a* or 41*b*, wherein the retaining sections 41*a* and 41*b* partially engage around the angled end regions 3*a* and 3*b* of a rod 3 when the guide rail 1 has been completely assembled. This type of fixing ensures that the guide rail 1 is prevented from tilting with respect to a rod 3.

Figure 5:
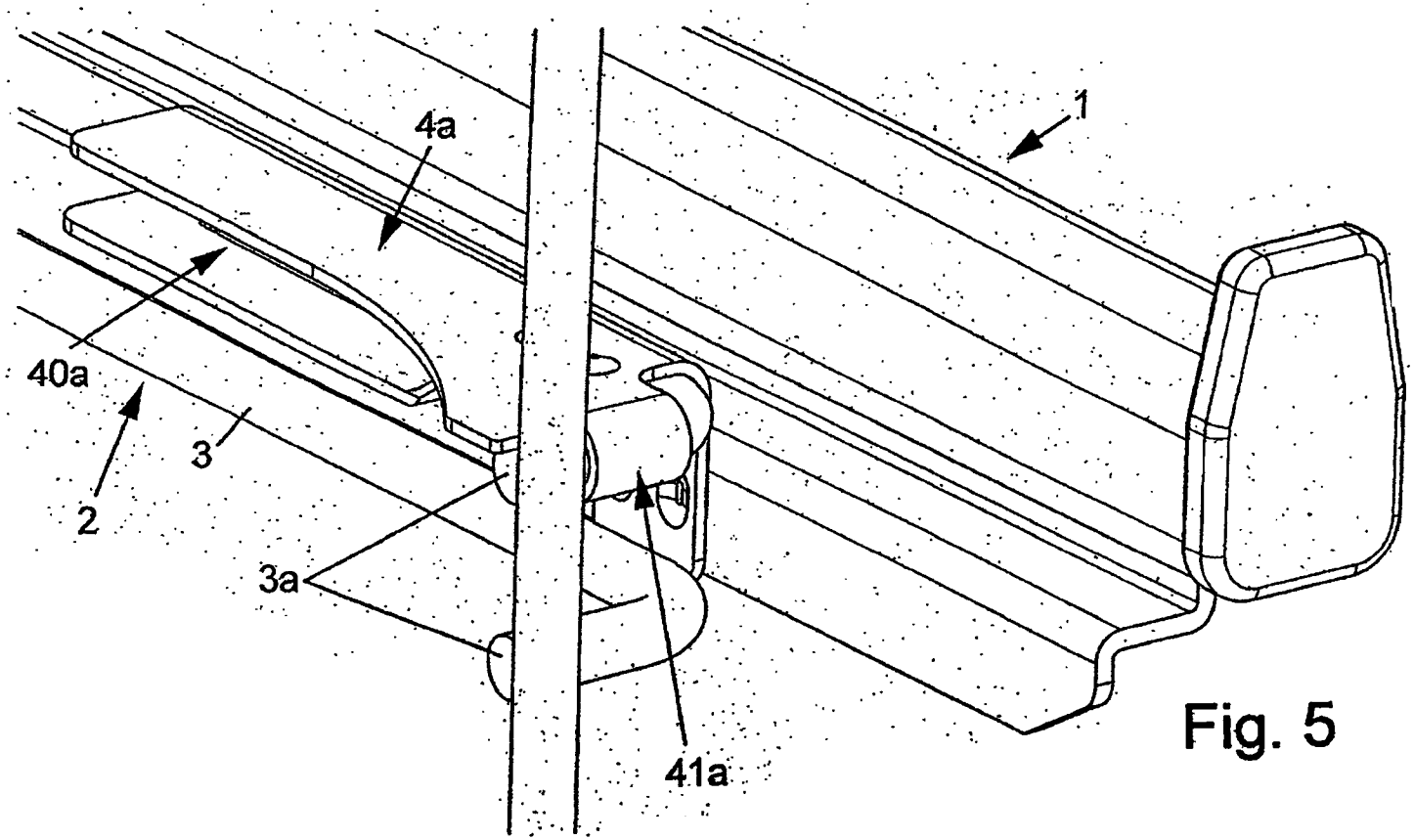
FIG. 5 shows a partial view in the direction of the arrow V in FIG. 2, in the final assembled position of the guide rail.
Figure 6:
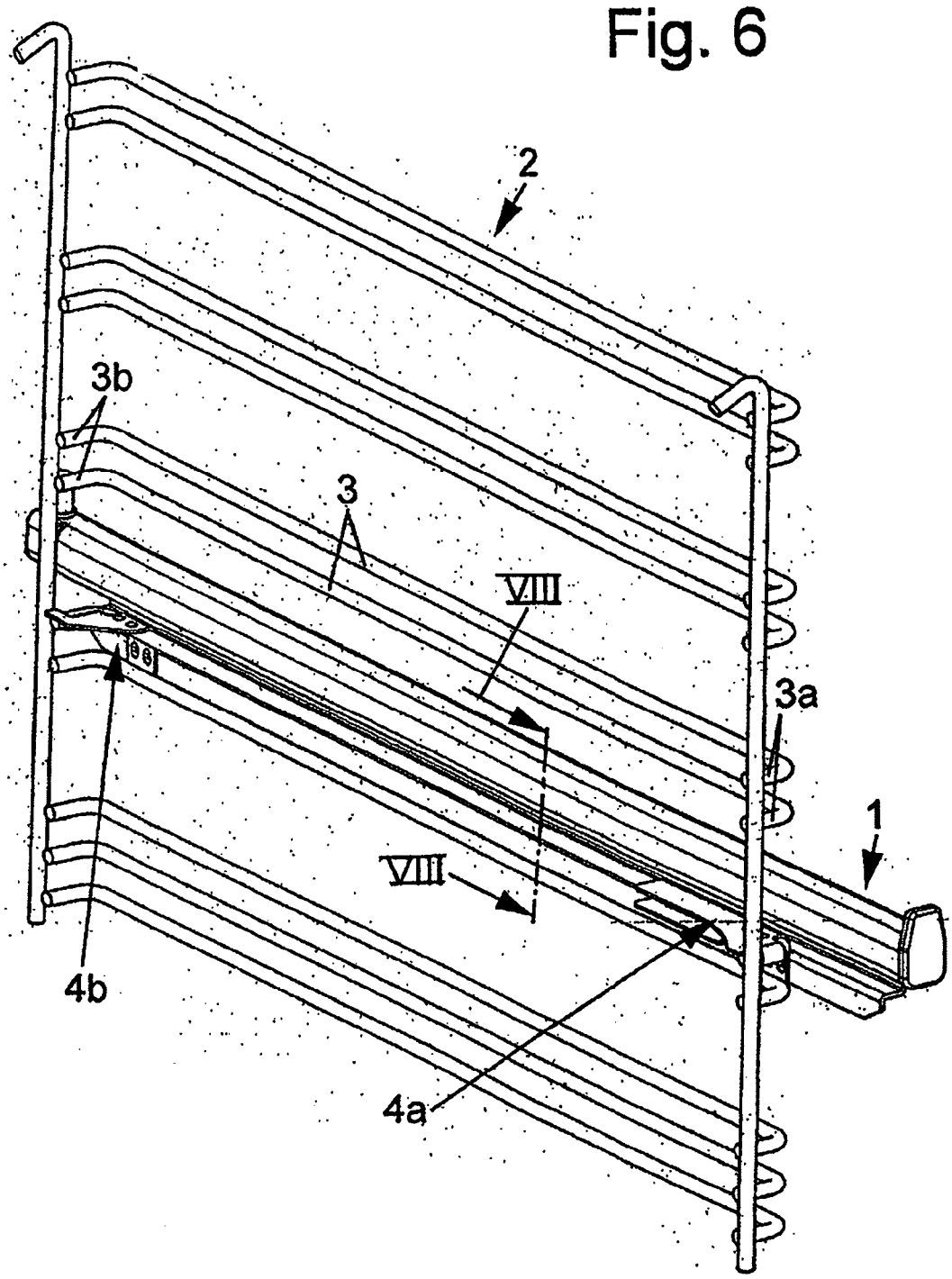
FIG. 6 shows a view of the rear of the side grid and a guide rail which is fixed thereto.

As is shown clearly, in particular, in FIG. 5, the second retaining section 41*a* of the retaining element 4*a* engages around the front, angled end region 3*a* of a rod 3, proceeding from the front side of the retaining element 4*a*.

The retaining section 41*b* of the rear retaining element 4*b* is open when viewed in the direction of the rear side of the guide rail 1. The retaining section 41*b* is formed from a lower limb 42 and an upper limb 43, wherein the lower limb 42 engages over the lower side of the rear, angled region 3*b* of a rod 3 and the limb 43 engages over the upper side of said angled end region 3*b*.

The lower limb 42 is bent out of the plane of the upper limb 43 of the rear retaining element 4*b*, wherein the resulting transition web 44 strikes against the front side of the rear, angled end region 3*b*. Thus, the front side of the rear, angled region 3*b* forms a limit stop for longitudinal displacement of the guide rail 1 in the direction of the rear end of a rod 3.

The described construction of the retaining elements 4*a* and 4*b* makes it possible to mount a guide rail 1 on a rod 3*a* in such a way that initially the rear retaining element 4*b* is pushed laterally onto a rod 3*a* and the guide rail 1 is then displaced in the direction of the rear side of the rod 3, until the transition web 44 strikes against the rear, angled end region 3*b* of the rod 3. The guide rail in the front-side end region, which rail is initially at an angle to the rod 3, is then pivoted against the guide rail 3, as a result of which the front retaining element 4*a* engages partially around the rod 3 both in its longitudinal extent region and in its angled end region 3*a*. The guide rail is then detachably fixed to the rod 3 by means of the quick-action fixing device.

The guide rail can be reliably prevented from becoming unintentionally detached from a rod 3 by means of a clamping action between the retaining elements 4*a* and 4*b* and the rod 3, or by means of a positive lock which can be produced by latching elements.

Figure 7:
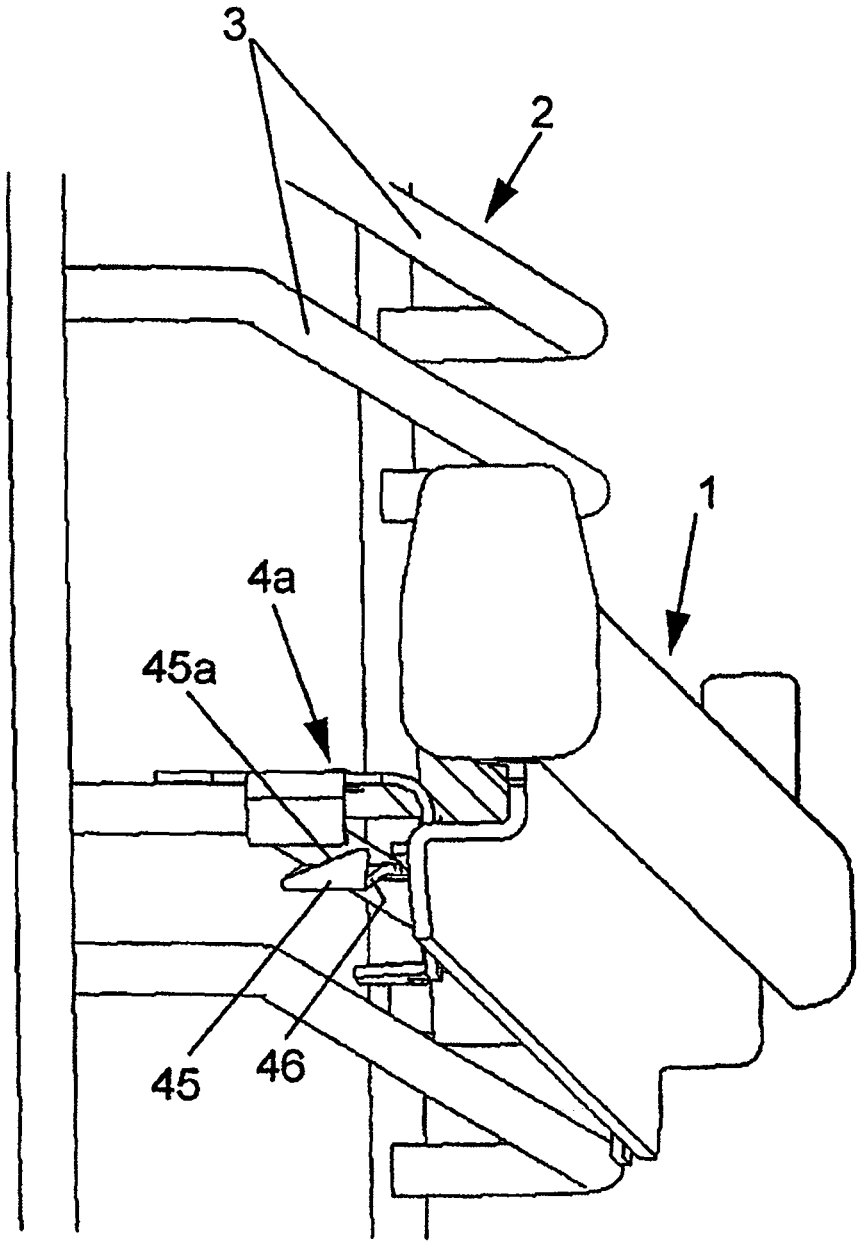
FIG. 7 shows a perspective view from the front of the guide rail shortly before the final connection to a rod of the side grid.
Figure 8:
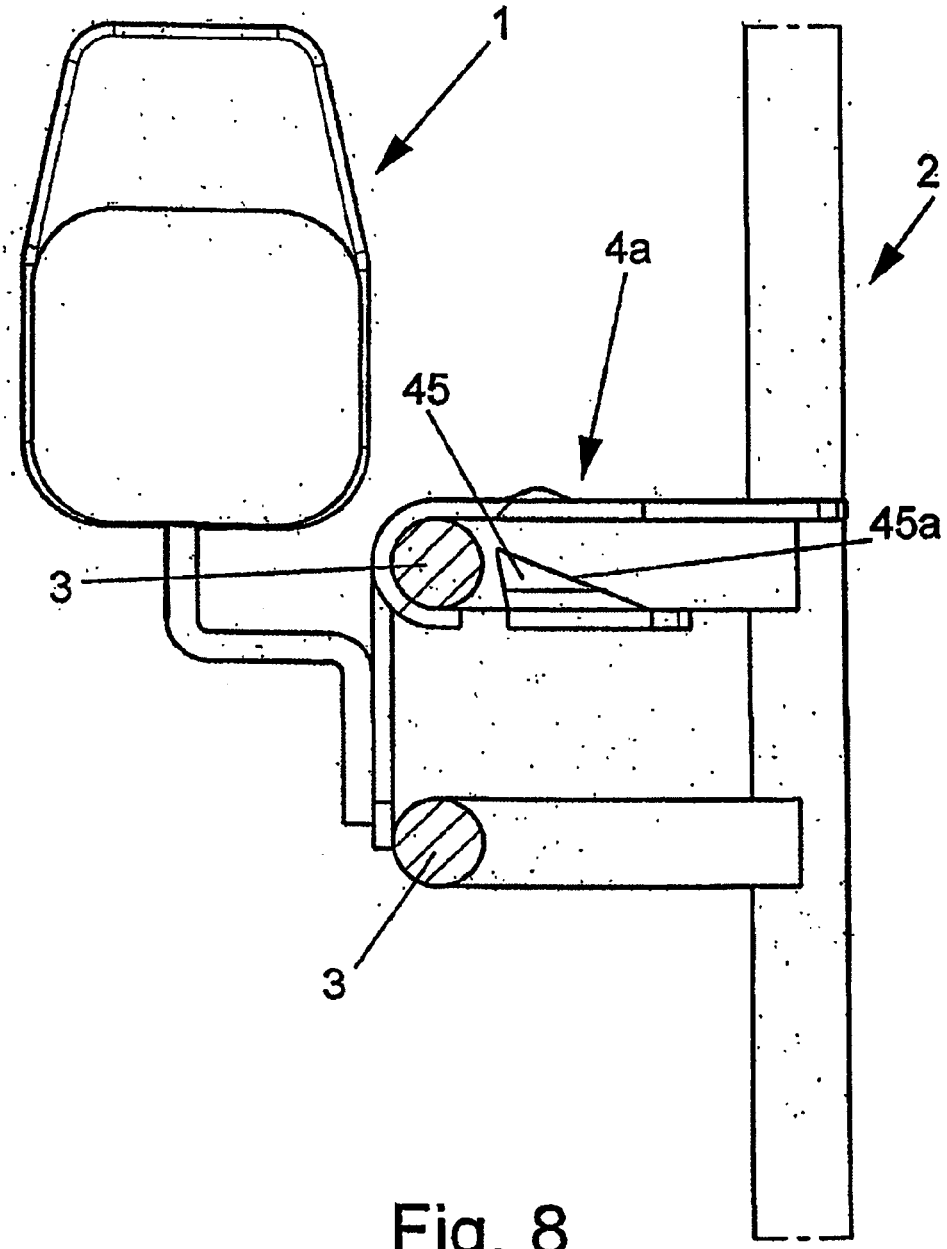
FIG. 8 shows a section according to the line VIII in FIG. 6.

By way of example, FIG. 7, in conjunction with FIG. 8, clearly shows that the front retaining element 4*a* is equipped with a securing lug 45 which is provided with an entry slope 45*a* which is inclined with respect to the horizontal. The securing lug 45 is connected overall to a spring limb 46 which affords the possibility of deflecting the securing lug 45 in the horizontal direction.

If, as described further above, the guide rail 1 has been pivoted against the rod 3 during the last assembly step, the entry slope 45*a* slides over the underside of the rod 3 and is pressed downward. If the guide rail 1 is in its intended position, the securing lug 45 springs upward again and therefore assumes the position shown in FIG. 8. As shown in FIG. 8 it can be seen that the guide rail 1 can be detached from the rod 3 only when the securing lug 45 is initially pressed downward manually, which is possible using a relatively simple tool or some other aid. A positive lock is therefore provided here between the retaining element 4*a* and the rod 3.

It goes without saying that other possibilities for positive locking are also conceivable. The same applies to the rear retaining element 4*b*.

Figure 9:
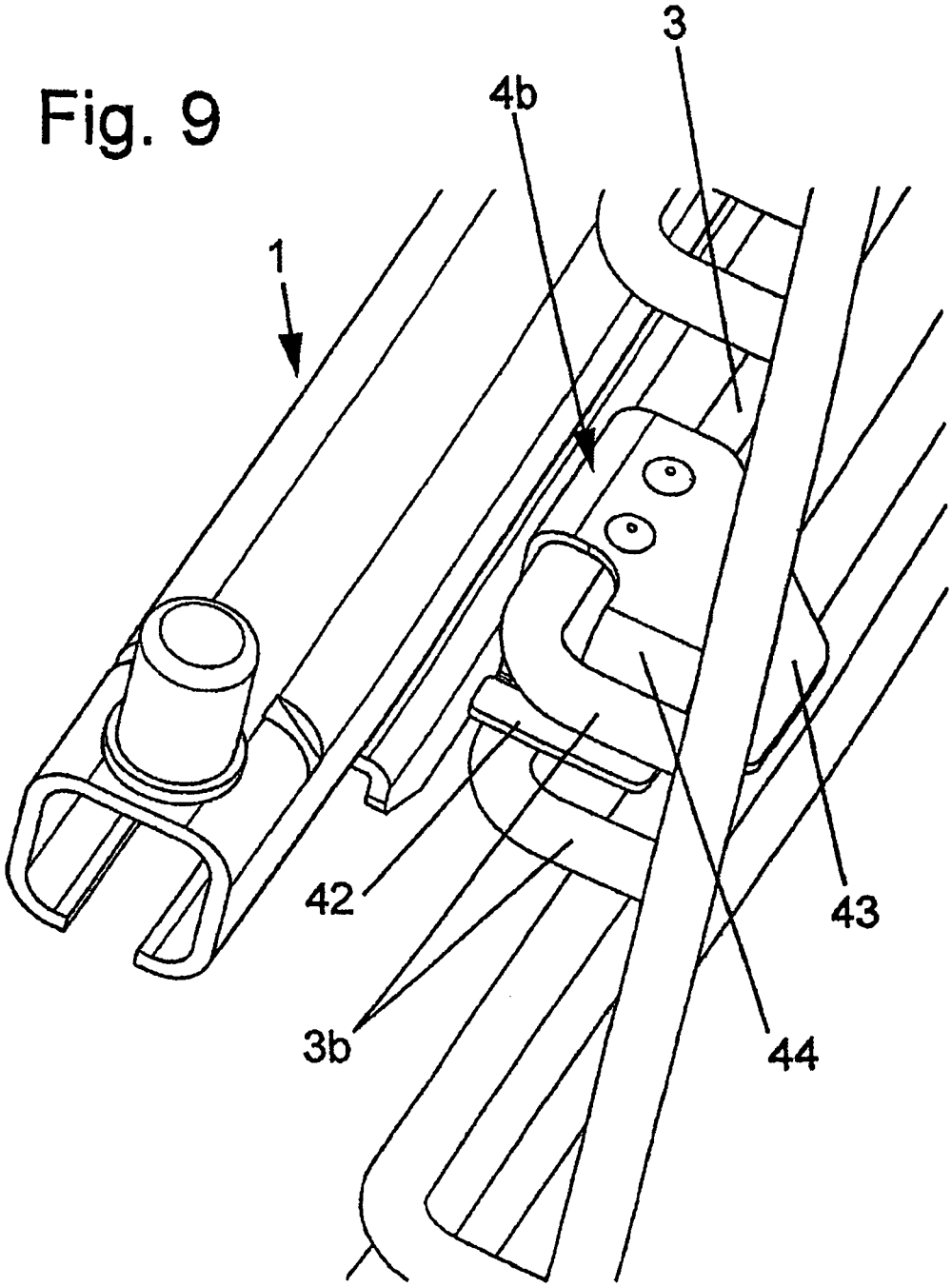
FIG. 9 shows a partial view, corresponding to FIG. 4, of a guide rail according to a further exemplary embodiment of the invention.

FIG. 9 shows a variant of a rear retaining element 4*b*. In this case, the lower limb 42, which engages underneath the rear, bent away end 3*b* of a rod 3, is designed with such a length that it also engages underneath the longitudinal extent region of a rod 3, such that, in this case, there is also means for preventing unintended detachment from the rod 3.

The retaining elements 4*a* and 4*b* are each advantageously produced as a single piece, to be precise are preferably produced from metal and in this case are produced as punched and bent parts.

The invention claimed is:

1. A guide rail which can be fixed to horizontally running rods, which are bent away at an angle in an end region, of a side grid of a baking oven, a dishwasher or similar appliances, the guide rail comprising:

a quick-action fixing device including both a front and a rear retaining element which are each fixed in the end regions of the guide rail and configured to be detachably fastened to a single horizontally running rod of the side grid;

wherein both of the front and the rear retaining elements have a first clip-type retaining section, which partially engages around the running rod in its longitudinal extent region, and a second clip-type retaining section, which partially engages around the running rod in its angled end regions, wherein the second clip-type retaining section of the rear retaining element is open in the direction of the rear side of the guide rail, such that the rail together with the quick-action fixing device are configured to be pushed and fixed onto one of the running rods, proceeding from the front side of the side grid, and wherein the front retaining element is provided with a securing lug which is integrally formed on a resilient tongue and has an entry slope which is inclined with respect to the horizontal, wherein the securing lug is connected to a spring limb which enables deflection of the securing lug in the horizontal direction, and, when the guide rail is in the assembled state, the securing lug engages behind one of the horizontally running rods on a side of the running rod which is remote from the guide rail, wherein a positive lock is provided between the front retaining element and the horizontally running rod once the guide rail has been pivoted against the running rod, the entry slope slides over the underside of the running rod, and the securing lug springs upward, and wherein the guide rail can be detached from the positive lock with that running rod only when the securing lug is initially pressed downward manually, wherein the front and rear retaining elements are punched and bent single pieces.

2. The guide rail of claim 1, wherein the retaining elements are configured to be fixed in a latching or clamping manner onto the running rod.

3. The guide rail of claim 1, wherein the rear retaining element has a lower and an upper limb, wherein the lower limb rests on the underside of the bent rear end of the rod and the upper limb rests on the upper side of the rear end of the rod and as such form the second clip-type retaining section.

4. The guide rail of claim 3, wherein, when the guide rail is in the assembled state, the lower limb also engages underneath the longitudinal extent region of the rod.

5. The guide rail of claim 1, wherein the clip-type retaining section of the rear retaining element delimits an approximately vertically angled transition web which forms a limit stop in the longitudinal direction of the guide rail.

6. An oven including at least one guide rail as recited in claim 1.

7. The guide rail of claim 1, wherein the securing lug is deflectable and deflection of the securing lug enables detachment of the pullout slide from the side grid for disassembly of the guide rail.

8. A guide rail assembly of a baking oven, a dishwasher or similar appliances, the guide rail assembly comprising:

a guide rail; and at least one horizontally running rod, which is bent away at an angle in an end region, of a side grid, wherein the guide rail includes:

a quick-action fixing device including both a front and a rear retaining element which are each fixed in the end regions of the guide rail and configured to be detachably fastened to a single horizontal running rod of the side grid;

wherein both of the front and the rear retaining elements have a first clip-type retaining section, which partially engages around the running rod in its longitudinal extent region, and a second clip-type retaining section, which partially engages around the running rod in its angled end regions, wherein the second clip-type retaining section of the rear retaining element is open in the direction of the rear side of the guide rail, such that the guide rail together with the quick-action fixing device are configured to be pushed and fixed onto one of the running rods, proceeding from the front side of the side grid, and wherein the front retaining element is provided with a securing lug which is integrally formed on a resilient tongue and has an entry slope which is inclined with respect to the horizontal, wherein the securing lug is connected to a spring limb which enables deflection of the securing lug in the horizontal direction, and, when the guide rail is in the assembled state, the securing lug engages behind one of the horizontally running rods on a side of the running rod which is remote from the guide rail, wherein a positive lock is provided between the front retaining element and the horizontally running rod once the guide rail has been pivoted against the running rod, the entry slope slides over the underside of the running rod, and the securing lug springs upward, and wherein the guide rail can be detached from the positive lock with that running rod only when the securing lug is initially pressed downward manually, wherein the front and rear retaining elements are punched and bent single pieces.

9. The guide rail of claim 8, wherein the rear retaining element has a lower and an upper limb, wherein the lower limb rests on the underside of the bent rear end of the rod and the upper limb rests on the upper side of the rear end of the rod and as such form the second clip-type retaining section.

10. The guide rail of claim 9, wherein, when the guide rail is in the assembled state, the lower limb also engages underneath the longitudinal extent region of the rod.

11. The guide rail of claim 8, wherein the clip-type retaining section of the rear retaining element delimits an approximately vertically angled transition web which forms a limit stop in the longitudinal direction of the guide rail.

12. An oven including at least one guide rail assembly as recited in claim 8.

* * * * *